US006213641B1

(12) United States Patent
Price

(10) Patent No.: US 6,213,641 B1
(45) **Date of Patent: *Apr. 10, 2001**

(54) THERMOPLASTIC BAG WITH OFFSET FASTENER

(75) Inventor: William D. Price, Midland, MI (US)

(73) Assignee: S. C. Johnson Home Storage, Inc., Racine, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/918,082

(22) Filed: Aug. 25, 1997

(51) Int. Cl.[7] ..... B65D 33/16
(52) U.S. Cl. ..... 383/63; 383/64; 383/104
(58) Field of Search ..... 383/104, 66, 63, 383/64, 906, 120, 43, 44, 61

(56) References Cited

U.S. PATENT DOCUMENTS

| | | | | |
|---|---|---|---|---|
| 2,378,503 | * | 6/1945 | Rohdin | 383/107 X |
| 3,367,380 | * | 2/1968 | Dickey | 383/906 X |
| 4,877,336 | * | 10/1989 | Peppiatt | 383/63 X |
| 5,080,497 | * | 1/1992 | Peppiatt | 383/66 X |
| 5,211,482 | * | 5/1993 | Tilman | 383/61 X |
| 5,725,309 | * | 3/1998 | Robinson | 383/61 X |

FOREIGN PATENT DOCUMENTS

| | | | | |
|---|---|---|---|---|
| 2752489 | * | 5/1979 | (DE) | 383/120 |
| 3119179 | * | 12/1982 | (DE) | 383/906 |
| 3925981 | * | 2/1991 | (DE) | 383/104 |
| 240650 | * | 10/1991 | (JP) | 383/63 |
| 5147661 | * | 6/1993 | (JP) | 383/63 |

* cited by examiner

*Primary Examiner*—Jes F. Pascua

(57) ABSTRACT

A reclosable thermoplastic bag having an offset fastener. The bag includes first and second sidewalls, each having a top, a bottom and two opposing side edges, the first and second sidewalls being attached together along the respective bottom and side edges; an inwardly folded top pleat positioned across the first sidewall; a reclosable fastener having at least two cooperating closure members, one closure member being positioned proximate to the top of the first sidewall above the pleat, the other closure member being positioned proximate to the top of the second sidewall, such that when the bag is filled and closed, the reclosable fastener is offset.

10 Claims, 4 Drawing Sheets

THERMOPLASTIC BAG WITH OFFSET FASTENER

BACKGROUND

The present invention relates to a reclosable thermoplastic bag.

Reclosable thermoplastic bags have a wide variety of applications, most notably in the food industry. The bags typically comprise two opposing sidewalls attached together along the side edges and bottom to form the sides and bottom of the bag. The bags also include a reclosable fastener along the tops of the sidewalls, or the mouth of the bag. Sometimes there is a pleat in the bottom of the bag which helps expand the volume available for storage.

Typically, the reclosable fastener extends along the centerline of the mouth of the bag. That is, when viewed from the top of the bag, the reclosable fastener would be positioned directly across the center. However, when the bag is filled and closed, the reclosable fastener along the centerline of the mouth tends to stick out past the side edges of the bag. This presents a problem when the bag is inserted into a secondary container such as a box, as the fastener sticks out too far, so that the bag does not easily fit into a close-fitting container.

Some modifications have been made in order to make the bags more suitable as liners. For example, U.S. Pat. No. Re. 34,317, issued to Van Erden et al., describes a bag having chamfer seals at the four corners of the bag, such that the four corners are freed from interfering with easy reception and packaging of the filled bag in a fairly close fitting carton. Another example is U.S. Pat. No. 5,275,491, issued to Kuge et al., which describes a bag that has inward folds extending vertically down along the side edges of the bag. Moreover, U.S. Pat. No. 5,080,253, issued to Zieke describes a cropped or chamfered top section of the bag as well as pleats along the sides of the bag. A problem with such modifications to the fastener is that when the bag mouth is opened, the available area is restricted, making it relatively difficult to fill the bags.

In the above mentioned reclosable bags, the reclosable fastener is disposed along the centerline of the mouth of the bag. The problem with such fasteners disposed along the centerline is that when the bag is filled, the fasteners stick out from the sides of the bag, making the bags undesirable as liners for close-fitting containers. That is, in order to use such bags as liners for containers, the containers must be larger than necessary in order to permit the fastener to fit inside the container, thereby wasting space inside the container. Furthermore, if the fastener is cut so that it does not stick out, then the bag becomes difficult to fill because the mouth opening is restricted. It would be an advance in the art of reclosable thermoplastic bags to provide a bag which can conveniently be used as a liner for a close-fitting container while still maintaining a relatively unrestricted mouth opening when the bag is opened.

SUMMARY OF THE INVENTION

The present invention provides an alternative to the bags of the prior art. In one aspect, the present invention is a reclosable thermoplastic bag comprising first and second sidewalls, each having a top, a bottom and two opposing side edges, the first and second sidewalls being attached together along the side edges and proximate to the bottom; an inwardly folded top pleat positioned across the first sidewall; a reclosable fastener having at least two cooperating closure members, one closure member being positioned proximate to the top of the first sidewall above the pleat, the other closure member being positioned proximate to the top of the second sidewall, such that when the bag is filled and closed, the reclosable fastener is offset.

In a second aspect, the present invention is a reclosable thermoplastic bag comprising two sidewalls, each having a top, a bottom and two opposing side edges, the sidewalls being attached together along the side edges and proximate to the bottom; a top inwardly folded pleat extending laterally between the side edges in one of the sidewalls; a reclosable fastener positioned proximate to the top of the sidewalls above the pleat, such that when the bag is filled and the reclosable fastener is closed, the reclosable fastener is offset.

An important advantage of the bag of the present invention is that the reclosable fastener is offset, such that it extends along the perimeter of the bag rather than along the centerline. As a result, the reclosable fastener does not stick out from the sides of the bag and does not need to be cut in order to fit inside a close-fitting container. This permits better use of the bag as a liner while still maintaining the full area of the mouth opening to be available for filling the bag.

DETAILED DESCRIPTION OF THE INVENTION

Figure 1:
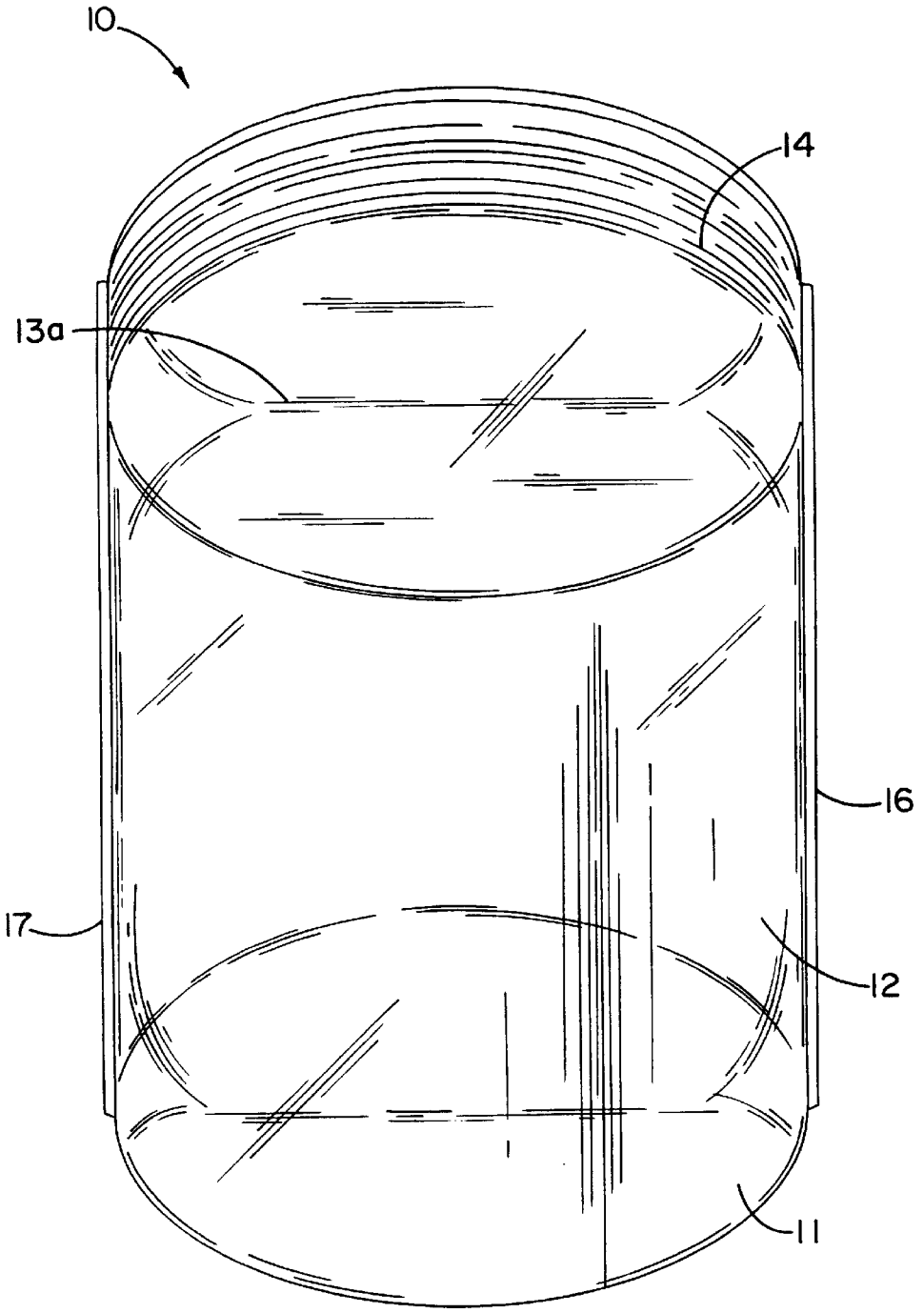
FIG. 1 is a perspective view of a filled bag of the present invention in an expanded condition.

FIG. 1 shows a thermoplastic bag B of the present invention. Bag 10 includes opposing sidewalls 11 and 12, an inwardly folded top pleat 13, and a reclosable fastener 14. In the embodiment shown, bag 10 also includes a bottom pleat 15.

Bag 10 can be made from any suitable thermoplastic film such as, for example, low density polyethylene, linear low density polyethylene, substantially linear copolymers of ethylene and a C3–C8 α-olefin, polypropylene, polyvinylidene chloride, mixtures of two or more of these polymers, or mixtures of one or more of these polymers with another thermoplastic polymer.

The thermoplastic film can be any desired thickness. Preferably, the film thickness is greater than about 0.5 mils, more preferably greater than about 0.75 mils, and most preferably greater than about 1.0 mils. Preferably, the film thickness is less than about 10.0 mils, more preferably less than about 7.5 mils, and most preferably less than about 5.0 mils.

Each sidewall 11 and 12 has a top 23*a*, 23*b* a bottom 25*a*, 25*b* and two opposing side edges. The tops of the sidewalls form a mouth 27 of the bag 10. The side edges of the sidewalls are common and sealed together to form common side seals 16 and 17. The side seals can be formed by any desired means, such as, for example, impulse sealing, hot wire sealing, hot knife sealing, folding, using an adhesive, or any other desired means. The sidewalls 11 and 12 are also attached to each other along the bottom 25 of the bag 10 by any desired means such as, for example, impulse sealing, hot wire sealing, hot knife sealing, folding, using an adhesive, or any other desired means.

An important feature of the present invention is top pleat 13 which is positioned laterally along the width of at least one of the sidewalls 11. Preferably, top pleat 13 is positioned proximate to the top of sidewall 11. "Proximate to the top" of a sidewall is defined herein as meaning closer to the top 23*a* of the sidewall 11 than to the bottom 25*a*.

Figure 3:
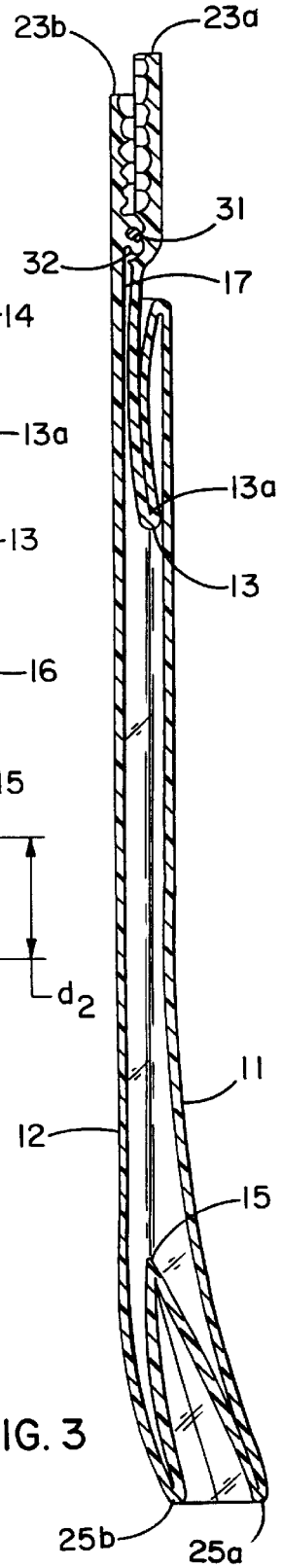
FIG. 3 is a cross sectional view of a bag in a collapsed condition taken along line 3—3 of FIG. 2, showing top and bottom pleats embodying the present invention.

Top pleat 13 is simply an inward fold extending laterally across the width of the sidewall 11. Top pleat 13 is an inward fold as opposed to an outward fold, meaning it forms a pocket inside the sidewall 11, as opposed to a flap which would stick out of the sidewall when in the collapsed condition, illustrated in FIG. 3.

Figure 4A:
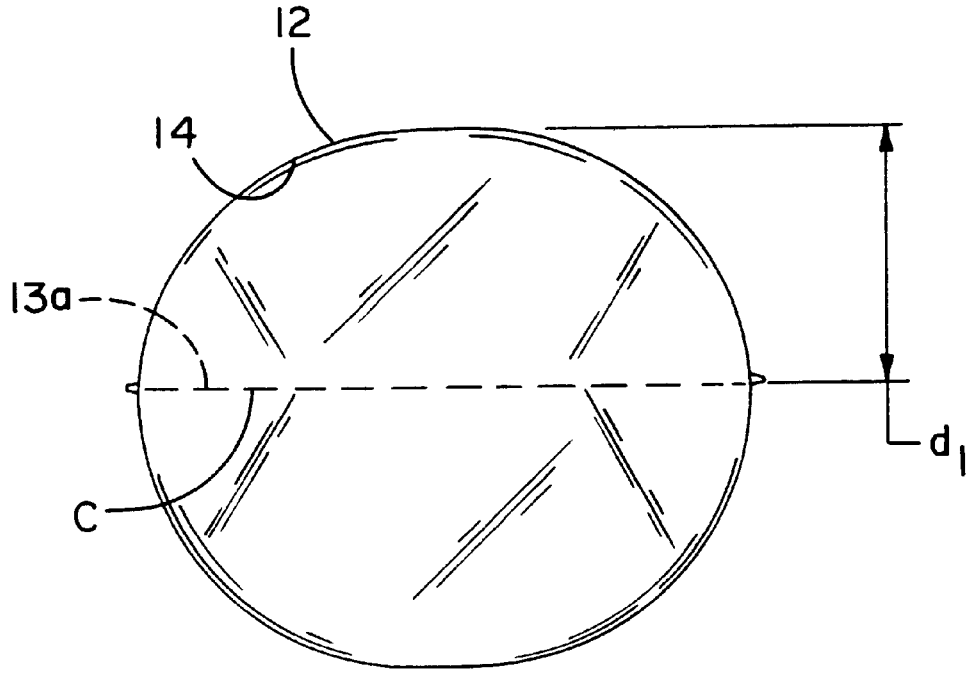
FIGS. 4A and 4B are top views of bags embodying the present invention shown in expanded conditions.
Figure 4B:
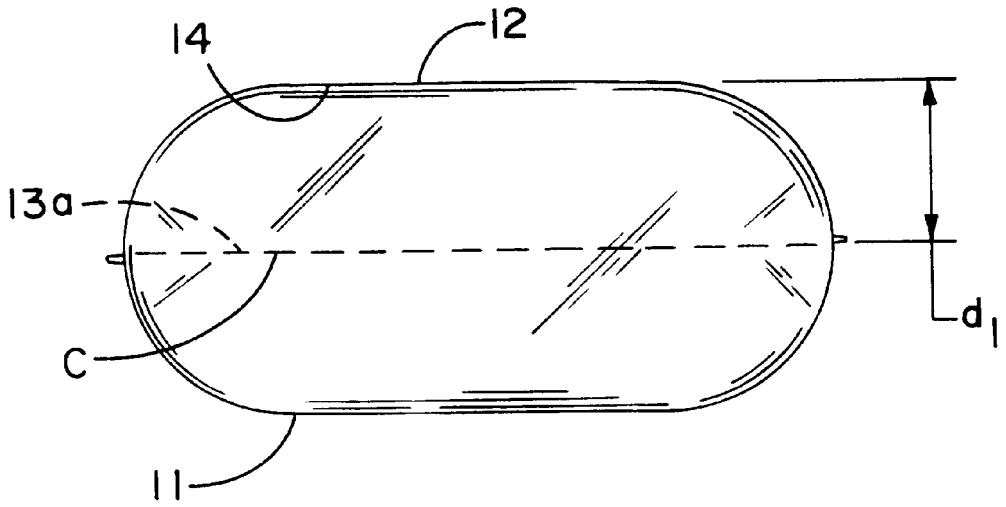

The top pleat 13 enables the sidewall 11 to effectively lengthen relative to the side wall 12 and thereby expand outwardly farther than the sidewall 11 could expand without the fold as illustrated in FIGS. 1 and 4*a*, 4*b*. Thus, when the bag is filled and the pleat 13 expanded, the inside crease 13*a* of top pleat 13 becomes the centerline C of the bag, as opposed to the fastener 14. In this manner, the reclosable fastener 14 is displaced from its initial central position illustrated in FIG. 3 when the bag 10 is collapsed to an offset position (illustrated in FIGS. 1, 4*a*, and 4*b*) when the bag is filled and expandable, as opposed to being disposed along the centerline of the mouth of the bag when filled.

FIGS. 4A and 4B illustrate top views of the offset fasteners of the present invention. The dashed lines in FIGS. 4A and 4B depict what is defined herein as the centerline C of the mouth of the bag. As shown, the reclosable fastener 14 does not extend along the centerline C of the mouth of the bag; rather, the reclosable fastener 14 is offset, such that it is positioned along the perimeter of the bag when the bag is filled and is bowed away from the wall 11 toward the wall 12.

Top pleat 13 can be any desired depth. The depth of the top pleat 13, $d_1$, is defined herein as being the distance between the bottom of the reclosable fastener 14 and the fold. Advantageously, $d_1$ is a maximum of ¼ times the width of the bag, w. The width of the bag, w, is defined herein as the distance from one side seal 16 of the bag to the other side seal 17.

Varying the depth, $d_l$, of the top pleat 13 will change the shape of the filled bag. For example, a relatively deep pleat having depth $d_1$, will result in a elliptically shaped bag when viewed from the top, as in FIG. 4A. On the other hand, a relatively shallow pleat having depth $d_1$ will result in more of a long, rectangular shape when viewed from the top, as in FIG. 4B. Thus, selection of the appropriate $d_1$ depends on the desired shape for the ultimate end use of the bag. Advantageously, when a bottom pleat 15 is incorporated into the bag, the depth of bottom pleat 15, $d_2$, is equal to dl. In this manner, the shape of the bag will be uniform from top to bottom. The bag can be cylindrical such that it is an effective storage bag for bread and the like; or the bag can have squared corners such that it is an effective liner for a cereal box and the like.

Figure 2:
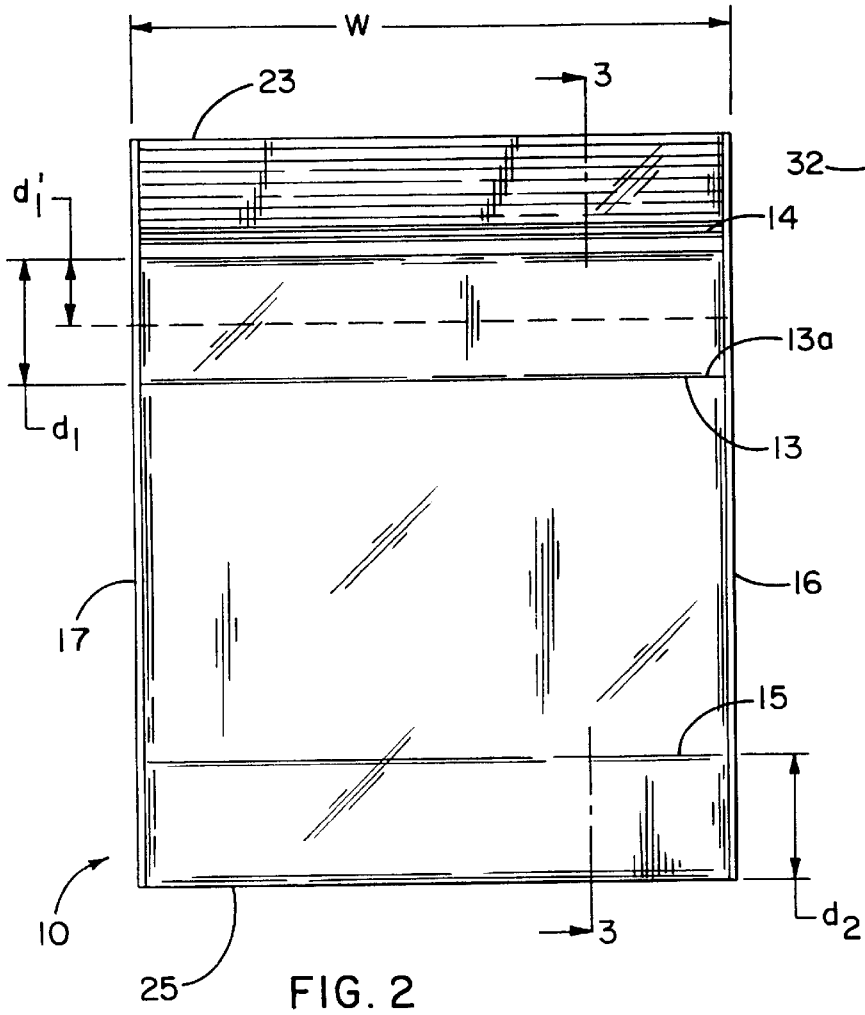
FIG. 2 is a front plan view of a bag of the present invention.

Reclosable fastener 14 is positioned along the width of bag 10 proximate to the top of bag 10. The reclosable fastener is positioned closer to the top 23 of the bag than top pleat 13, such that the reclosable fastener is positioned between top pleat 13 and the top 23 of the bag when the bag is flat as in FIG. 2.

Figure 5:
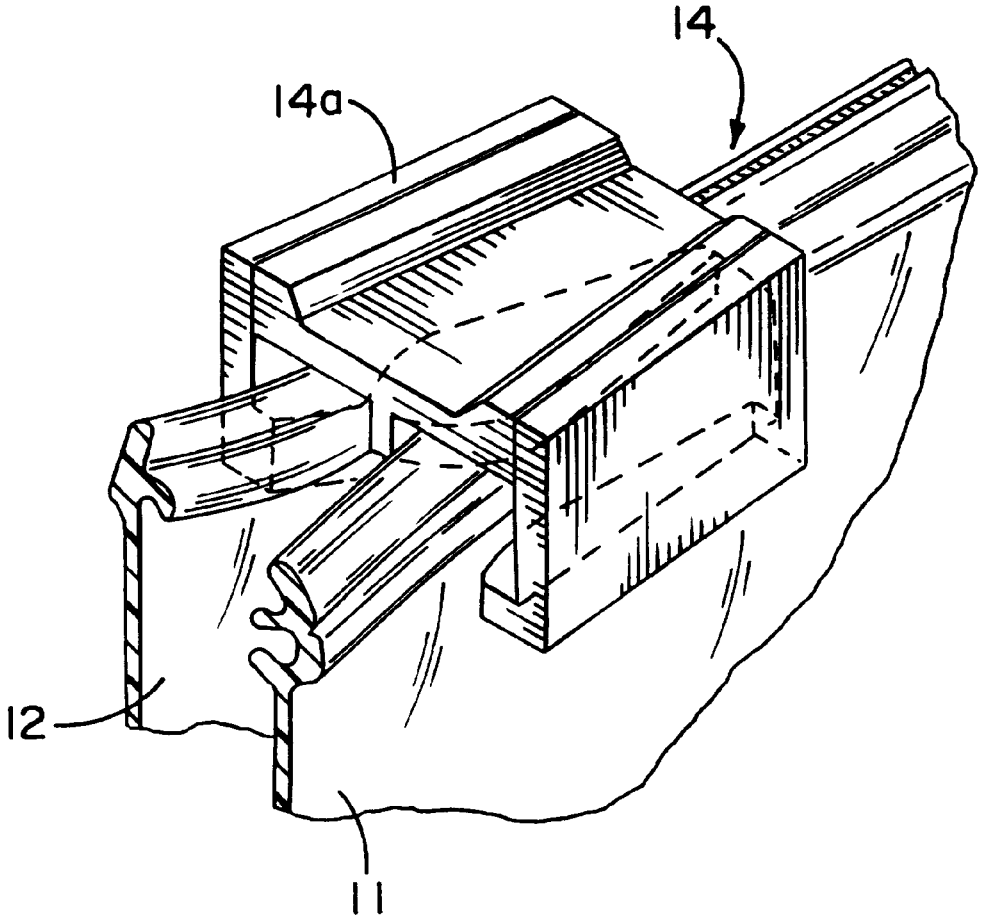
FIG. 5 is an enlarged fragmentary perspective view of an alternative releasable fastening system employing a slider

Reclosable fastener 14 can be any desired type of fastener having matable, recloseable fastening members or elements 31, 32 carried by the walls 11, 12 of the bag 10 adjacent the top 23 thereof, such as, for example, a plastic zipper, a plastic zipper with a slider, an adhesive fastener, VELCRO, snaps, or any other type of reclosable fastener. Preferably, reclosable fastener 14 is a plastic zipper having cooperating closure elements, such as, for example, rib and groove elements as described in U.S. Pat. No. 5,140,727, rolling action closure elements as described in U.S. Pat. No. 5,007,143, or U-shaped closure elements with interlocking hooks as described in U.S. Pat. No. 4,747,702. Furthermore, if desired, the fastener can include a slider 14*a*(FIG. 5) which travels along the fastener and is adapted to open or close the fastener, such as, for example, those described in U.S. Pat. No. 5,070,583 and U.S. Pat. No. 5,007,142.

The reclosable fastener 14 may be extruded separately and attached to the sidewalls 11 and 12 of the bag or it may be extruded integrally with the sidewalls of the bag. The sidewalls and the reclosable fastener of the present invention can be made using methods well known in the art, such as, for example, by blow or cast extrusion.

The bag of the present invention can be made using a sheet of film with a reclosable fastener disposed along the width of the sheet of film. Preferably, the sheet of film is folded so as to form two layers of film with the reclosable fastener positioned at one end of the layers of film. The bag of the present invention is preferably made by inwardly folding a portion of one of the layers of film proximate to the fastener to form a top pleat; sealing the two layers of film together transversely to the top pleat to form a first side seal; sealing the two layers of film together transversely to the top pleat at a distance w from the first side seal to form a second side seal. Preferably, the method also includes inwardly folding at least one of the layers proximate to the bottom edge 25 to form a bottom pleat 15.

Both the top and bottom pleats can be formed using such methods as described in U.S. Pat. Nos. 5,246,416, 5,186,707, 5,083,999, 5,147,278, incorporated herein by reference.

EXAMPLE

A thirty-inch film is formed using standard cast-film equipment. The film includes a rib-and-groove type of plastic zipper such that the rib element is at one end of the film and the groove element is at the other end of the film. The film is folded in half such that two layers of film are formed, one layer having the rib element at a mouth end of the layer, the other layer having the groove element at a mouth end. The rib and groove elements are positioned such that they may interlock with each other. The fold between the two layers is the bottom edge of the bag.

A top pleat is formed by inwardly folding one of the layers to a depth $d_1$ of 2.5 inches (6.35 cm). A bottom pleat is then formed by inwardly folding at the bottom edge to a depth $d_2$ of 2.5 inches (6.35 cm). The two layers are then impulse sealed together transversely to the rib and groove closure elements at a distance 10 inches (25.4 cm) apart.

What is claimed is:

1. A reclosable thermoplastic storage bag configurable in collapsed, expanded open, and expanded closed positions, the bag having a top and a bottom, the bag having substantially uniform dimensions at the top and the bottom when in the expanded position, the bag being openable and reclosable at a mouth provided at the top of the bag, the bag comprising:

a first side wall having a top edge, a bottom edge and opposed first and second side edges;

a second side wall having a top edge, a bottom edge and opposed first and second side edges, the first side edge of the first side wall being joined to the first side edge of the second side wall, the second side edge of the first side wall being joined to the second side edge of the second side wall;

a bottom pleat extending between the first and second side wall bottom edges, the bottom pleat folding inwardly toward the top edges of the first and second side wall when the bag is in the collapsed position, the bottom pleat being unfolded to a planar configuration orthogonal to the first and second side walls when the bag is in the expanded closed and expanded open positions, the bottom pleat occupying a first area when the bag is in the expanded closed and expanded open positions;

a top pleat extending from the first side wall top edge toward the second side wall top edge, the top pleat being foldable inwardly toward the bottom edge of the first and second side walls when in the collapsed position, the top pleat being foldable inwardly toward the bottom edge of the first and second side walls and forming a mouth when the bag is in the expanded open position, the mouth having a cross-sectional area substantially equal to the first area of the bottom pleat, the top pleat being unfolded to a planar configuration parallel to the bottom pleat when the bag is in the expanded closed position;

a first reclosable fastening member provided at the top edge of the second side wall; and a second reclosable fastening member provided at an end of the top pleat adjacent the second side wall top edge, the first and second reclosable fastening members being centrally positioned between the first and second side walls when the bag is in the collapsed position, the first and second reclosable fastening members being joined and in an offset position bowed outwardly away from the first side wall when the bag is in the expanded closed position, the first and second reclosable fastening member being spaced apart and being bowed outwardly away from the one another when the bag is in the expanded open position.

2. The bag of claim 1 wherein said top pleat forms a pocket in said one wall when said bag is in said collapsed condition having an inside crease along a bottom of said pleat, said crease lying along a centerline of said bag about midway between said walls when said bag is in said expanded condition.

3. The bag of claim 2 wherein said reclosable fasteners extend along a perimeter of said bag in spaced relation to said centerline of said bag when said bag is in said expanded condition.

4. The bag of claim 1 wherein said top pleat has a predetermined depth $d_1$ that is a maximum of ¼ times a predetermined width w of said bag.

5. The bag of claim 4 wherein said bottom pleat extends laterally between said side seals of said walls and has a depth $d_2$ which is equal to said depth $d_1$ of said top pleat.

6. The bag of claim 1 wherein at least one of said walls includes an inwardly folded bottom pleat extending laterally between said side seals of said walls.

7. The bag of claim 1 wherein said reclosable fastening members comprise a plastic zipper having cooperating closure elements.

8. The bag of claim 7 wherein said zipper includes a slider.

9. The bag of claim 1 wherein said pleat section is unattached to said one wall in the region between said side seals.

10. The bag of claim 1 wherein said pleat section has wall portions extending inwardly of said one wall when said bag is in said collapsed condition provided by an inwardly folded extension of said one wall, said wall portions joined by a bottom crease of said pleat section and being otherwise unattached to said one wall and one another in the region between said side seals.

* * * * *